US005755111A

United States Patent [19]

Toyama

[11] Patent Number: 5,755,111

[45] Date of Patent: May 26, 1998

[54] HIGH-LOW PRESSURE PASSAGE SWITCHING DEVICE IN HEATING-COOLING APPARATUS

[75] Inventor: Isamu Toyama, Fuji, Japan

[73] Assignee: Fuji Injector Corporation, Odawara, Japan

[21] Appl. No.: 707,393

[22] Filed: Sep. 4, 1996

[51] Int. Cl.[6] ..... F25B 30/02

[52] U.S. Cl. ..... 62/324.6; 137/625.43; 251/129.2

[58] Field of Search ..... 62/324.6; 137/625.43, 137/874; 251/129.2

[56] References Cited

U.S. PATENT DOCUMENTS

| | | | |
|---|---|---|---|
| 3,047,020 | 7/1962 | Barrett, Jr. | 137/874 |
| 4,526,202 | 7/1985 | Chorkey | 137/874 |
| 5,188,151 | 2/1993 | Young et al. | 137/874 |

FOREIGN PATENT DOCUMENTS 61-6468 1/1986 Japan .

*Primary Examiner*—William E. Tapolcai
*Attorney, Agent, or Firm*—Wenderoth, Lind & Ponack

[57] ABSTRACT

A high-low pressure passage switching device in a heating-cooling apparatus comprises a hollow tube; a high pressure gas inlet port formed in a wall of the hollow tube and connected to a high pressure gas outlet port of a compressor; a first high pressure gas outlet port/low pressure gas inlet port formed in the wall of the hollow tube and connected to one end of a heat exchanger; a second high pressure gas output port/low pressure gas inlet port formed in the wall of the hollow tube and connected to the other end of the heat exchanger; and a flow passage switch disposed within the hollow tube and capable of rotating about a fixed axis. The flow passage switch is adapted to supply a high pressure gas introduced from the high pressure gas inlet port selectively to one of the first high pressure gas outlet port/low pressure gas inlet port and the second high pressure gas outlet port/low pressure gas inlet port to thereby switch the high pressure gas flow passage. When a high pressure gas is supplied to one end of the heat exchanger through a selected one of the first high pressure gas outlet port/low pressure gas inlet port and the second high pressure gas outlet port/low pressure gas inlet port, a low pressure gas from the other end of the heat exchanger is introduced into the hollow tube through the other port so that the interior of the hollow tube is normally filled with low pressure gas. A low pressure gas outlet port is formed in the wall of the hollow tube and connected to a low pressure gas inlet port of the compressor so that the low pressure gas within the hollow tube is guided to the low pressure gas inlet port.

19 Claims, 6 Drawing Sheets

HIGH-LOW PRESSURE PASSAGE SWITCHING DEVICE IN HEATING-COOLING APPARATUS

BACKGROUND OF THE INVENTION

1. Field of the Invention

This invention relates to a high-low pressure passage switching device for a coolant in a heating-cooling apparatus, namely, an air-conditioning apparatus.

2. Brief Description of the Prior Art Japanese Patent Application Laid-Open No. Sho 61-6468 discloses a typical example of a high-low pressure passage switching valve for a coolant in a conventional heating-cooling apparatus.

As shown in FIG. 7, the switching valve has a high pressure gas inlet port 2 which is formed in a side wall of an air-tight outer tube 1 and which is connected to an outlet port of a compressor 10, so that the outer tube 1 is normally filled with a high pressure gas. The switching valve also has first and second high/low pressure gas inlet/outlet ports 3, 4 connected to a heat exchanger (an indoor coil 11*a* and an outdoor coil 11*b*) and a low pressure gas outlet port 5 connected to an inlet port of the compressor 10, the ports 3, 4 and 5 being arranged, side by side, on that part of the side wall of the outer tube 1 which is located opposite the high pressure gas inlet port 2. A slide block 6 acting as a flow passage switching valve is disposed within the outer tube 1 such that the block 6 is capable of axially and linearly sliding, rightwardly and leftwardly, along an inner surface of that part of the outer tube 1 where the ports 3, 4 and 5 are open. The rightward and leftward sliding of the slide block 6 causes a selected one of the first and second high/low pressure gas inlet/outlet ports 3, 4 to communicate with the low pressure gas outlet port 5 through the slide block 6. By doing this, a proceeding direction of a cooling gas, this gas coming from the compressor 10 and passing through the heat exchangers 11*a*, 11*b*, is switched to the opposite direction.

The outer tube 1 is provided on an inner curved-surface thereof with a valve seat 11 so that the slide block 6 linearly slides on a valve seat surface consisting of a planar surface, and a high pressure gas within the outer tube 1 is supplied to the slide block 6 to urge the block 6 against the surface of the valve seat 11 in an air-tight manner.

In the above-mentioned prior art, as means for actuating the slide block 6, there is provided a pair of pistons 7, 8 connected to the slide block 6 and a pilot valve 9 for actuating the pistons 7, 8 utilizing a difference between a high pressure and a low pressure of gas (coolant) taken into and discharged out of the compressor 10 via the switching valve within the outer tube 1.

However, the above switching valve has a problem in that, since the passage switching slide block 6 is of a one-side abutment type, intimate contact of the sliding surface is difficult to obtain, thus resulting in insufficient sealing.

Furthermore, since a high pressure is supplied normally from the high pressure gas inlet port 2 to the comparatively large sliding surface of the slide block 6 so that the block 6 linearly slides, a large amount of slide resistance is produced at the sliding surface. Since this prevents a smooth sliding of the slide block 6, responsibility of the block 6 is degraded when the valve is switched. Moreover, since the slide block 6 is repeatedly slid under high pressure, it is susceptible to wear. This worsens the problem of insufficient sealing.

In order to cope with the structural problem just mentioned, it is necessary to make efforts such as disposing a slide block sliding valve seat 11 on the inner curved-surface of the outer tube 1, selecting materials of the slide block 6 and valve seat 11 to reduce the problem, improving the machining techniques, and the like.

Also, in the above prior art, as the means for actuating the slide block 6, the pair of pistons 7, 8 connected to the slide block 6 are disposed within the outer tube 1 and the pilot valve 9 is provided for actuating the pistons 7, 8 utilizing a difference between a high pressure and a low pressure of gas (coolant) taken into and discharged out of the compressor 10 via the switching valve, thus requiring piping therefor. Accordingly, the construction is complicated and the number of component parts and assembling processes are high. In addition, the cost is high.

The present invention has been accomplished in view of the above problems inherent in the prior art.

SUMMARY OF THE INVENTION

It is, therefore, an object of the present invention to provide a high-low pressure passage switching device in a heating-cooling apparatus, in which reliability of a switching valve is increased and construction of the switching valve is simplified.

To achieve the above object, according to a first embodiment of the invention, there is essentially provided a high-low pressure passage switching device in a heating-cooling apparatus comprising a hollow tube; a high pressure gas inlet port formed in a wall of the hollow tube and connected to a high pressure gas outlet port of a compressor; a first high pressure gas outlet port/low pressure gas inlet port formed in the wall of the hollow tube and connected to one end of a heat exchanger; a second high pressure gas output port/low pressure gas inlet port formed in the wall of the hollow tube and connected to the other end of the heat exchanger; and flow passage switching means disposed within the hollow tube and capable of rotating about a fixed axis. The flow passage switching means is adapted to supply a high pressure gas introduced from the high pressure gas inlet port selectively to one of the first high pressure gas outlet port/low pressure gas inlet port and the second high pressure gas outlet port/low pressure gas inlet port to thereby switch the high pressure gas flowing passage. When a high pressure gas is supplied to one end of the heat exchanger through selected one of the first high pressure gas outlet port/low pressure gas inlet port and the second high pressure gas outlet port/low pressure gas inlet port, a low pressure gas from the other end of the heat exchanger is introduced into the hollow tube through the other port so that the interior of the hollow tube is normally filled with low pressure gas. A low pressure gas outlet port is formed in the wall of the hollow tube and connected to a low pressure gas inlet port of the compressor so that the low pressure gas within the hollow tube is guided to the low pressure gas inlet port.

It is preferred that the high pressure gas inlet port is disposed at one end wall on an axis of the hollow tube, the low pressure gas outlet port is disposed at the other end wall on the same axis of the hollow tube, and the first and second high pressure gas outlet ports/low pressure gas inlet ports are disposed on a circular orbit about the axis of a side wall of the hollow tube.

It is also preferred that the high pressure gas flow passage switching means is constituted by a rotary switching shaft rotatable on the axis within the hollow tube, and a gas passage is formed in the center of the rotary switching shaft, the gas passage being provided at one end thereof with a high pressure gas inlet port opening at one end face of the shaft so as to be communicated with the high pressure gas inlet port, and at the other end with a high pressure gas outlet port opening at a side wall of the shaft so as to be communicated with a selected one of the first and second high pressure gas outlet ports/low pressure gas inlet ports.

It is also preferred that the rotary switching shaft is rotated by a plunger extending through the side wall of the hollow tube.

It is also preferred that the rotary switching shaft is provided at an eccentric location at one end thereof with a pressure-bearing portion, the pressure-bearing portion being pressed by a ball disposed at a distal end of the plunger so that the rotary switching shaft is rotated.

According to the second embodiment, there is provided a high-low pressure passage switching device in a heating-cooling apparatus comprising a hollow tube; a high pressure gas inlet port formed in a wall of the hollow tube and connected to a high pressure gas outlet port of a compressor so that a high pressure gas from the compressor is introduced into the hollow tube to normally fill the interior of the hollow tube with the high pressure gas; a first high pressure gas outlet port/low pressure gas inlet port formed in the wall of the hollow tube and connected to one end of a heat exchanger; a second high pressure gas output port/low pressure gas inlet port formed in the wall of the hollow tube and connected to the other end of the heat exchanger; a low pressure gas outlet port formed in the wall of the hollow tube and connected to an inlet port of the compressor; and flow passage switching means disposed within the hollow tube and capable of rotating about a fixed axis. The flow passage switching mean is adapted to cause the low pressure gas outlet port to communicate selectively with one of the first high pressure gas outlet port/low pressure gas inlet port and the second high pressure gas outlet port/low pressure gas inlet port. When the switching means is switched to a selected one of the first and second high pressure gas outlet ports/low pressure gas inlet ports, the high pressure gas within the hollow tube is guided to one or the other end of the heat exchanger through the other port and the low pressure gas from the other end of the heat exchanger is introduced into the flow passage switching means so that the low pressure gas is guided to an inlet port of the compressor from the low pressure gas outlet port.

It is preferred that the high pressure gas inlet port is disposed at one end wall on an axis of the hollow tube, the low pressure gas outlet port is disposed at the other end wall on the same axis of the hollow tube, and the first and second high pressure gas outlet ports/low pressure gas inlet ports are disposed on a circular orbit about the axis of a side wall of the hollow tube.

It is also preferred that the low pressure gas flow passage switching means is constituted by a rotary switching shaft rotatable on the axis within the hollow tube, and a gas passage is formed in the center of the rotary switching shaft, the gas passage being provided at one end thereof with a low pressure gas outlet port opening at one end face of the shaft so as to be communicated with the low pressure gas outlet port, and at the other end with a low pressure gas inlet port opening at a side wall of the shaft so as to be communicated with a selected one of the first and second high pressure gas outlet ports/low pressure gas inlet ports.

It is also preferred that the rotary switching shaft is rotated by a plunger extending through the side wall of the hollow tube.

It is also preferred that the rotary switching shaft is provided at an eccentric location at one end thereof with a pressure-bearing portion, the pressure-bearing portion being pressed by a ball disposed at a distal end of the plunger so that the rotary switching shaft is rotated.

Still other objects and advantages of the present invention will become readily apparent to those skilled in the art from the following detailed description, wherein only the preferred embodiments of the invention are shown and described, simply by way of illustration of the best mode contemplated for carrying out the invention. As will be realized, the present invention is capable of other and different embodiments, and its several details are capable of modification in various obvious respects all without departing from the invention. Accordingly, the drawings and description are to be regarded as illustrative in nature, and not as restrictive.

DETAILED DESCRIPTION OF THE EMBODIMENTS

Figure 1A:
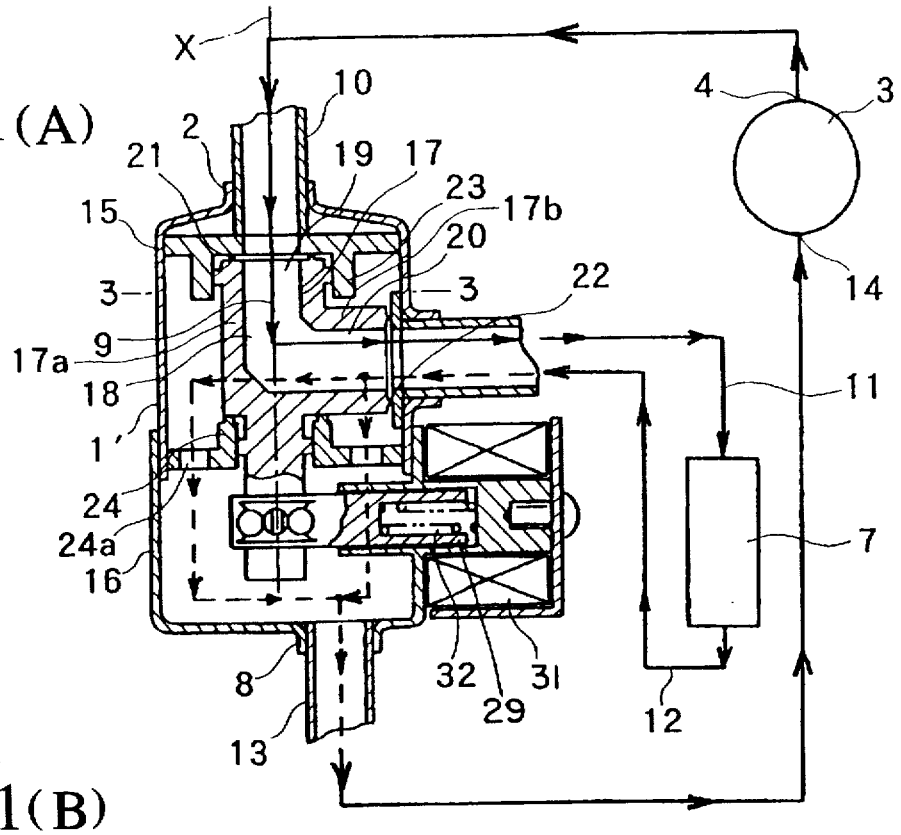
FIG. 1(A) is a vertical sectional view showing an example of a specific construction thereof.

Before proceeding to the detailed description, the basic ideas of the first embodiment are described with reference to FIGS. 1 through 4.

In the drawings, reference numeral 1 denotes a hollow tube. A high pressure gas inlet port 2 is formed in the wall of this hollow tube 1. A high pressure gas outlet port 4 of a compressor 3 is connected to the high pressure gas inlet port 2 through piping 10, so that a high pressure is supplied to the port 2 from the outlet port 4. The hollow tube 1 is provided at its wall with a low pressure gas inlet port 5 also serving as a first high pressure gas outlet port (hereinafter referred to as the "first high/low pressure gas inlet/outlet port") and a lower pressure gas inlet port 6 also serving as a second high pressure gas outlet port (hereinafter referred to as the "second high/low pressure gas inlet/outlet port"). The first high/low pressure gas inlet/outlet port 5 is connected to one end of a heat exchanger 7 through piping 11, and the other end of the heat exchanger 7 is connected to the second high/low pressure gas inlet/outlet port 6 through piping 12.

The hollow tube 1 contains therein a high pressure flow passage switching means 9 for supplying the high pressure gas supplied from the high/low pressure gas inlet port 3 selectively to the first and second high/low pressure gas inlet/outlet ports 5 and 6.

Figure 1B:
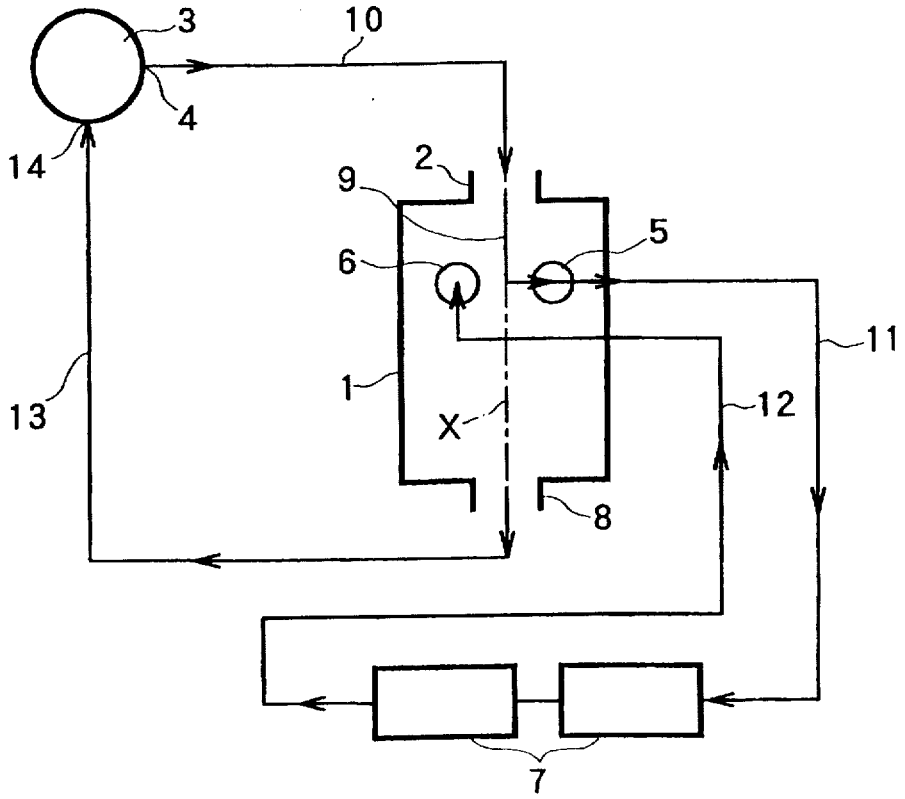
FIG. 1(B) is an explanatory view for explaining the principles of a high-low pressure flow passage switching device in a heating-cooling apparatus according to a first embodiment, in which the flow passage is switched to one direction.

As shown in FIGS. 1(A) and 1(B), when the high pressure flow passage switching means 9 is switched to the first high/low pressure gas inlet/outlet port 5, the high pressure gas from the compressor 3 is allowed to pass through the high pressure gas inlet port 2, then pass through a gas passage 18 within the switching means 9, and is supplied to the first high/low pressure gas inlet/outlet port 5. The high pressure gas from the inlet/outlet port 5 is supplied to one end of the heat exchanger 7 through the piping 11, whereas the lower pressure gas from the other end of the heat exchanger 7 is supplied to the second high/low pressure gas inlet/outlet port 6 through the piping 12 so that the low pressure gas is filled in the hollow tube 1.

Figure 2A:
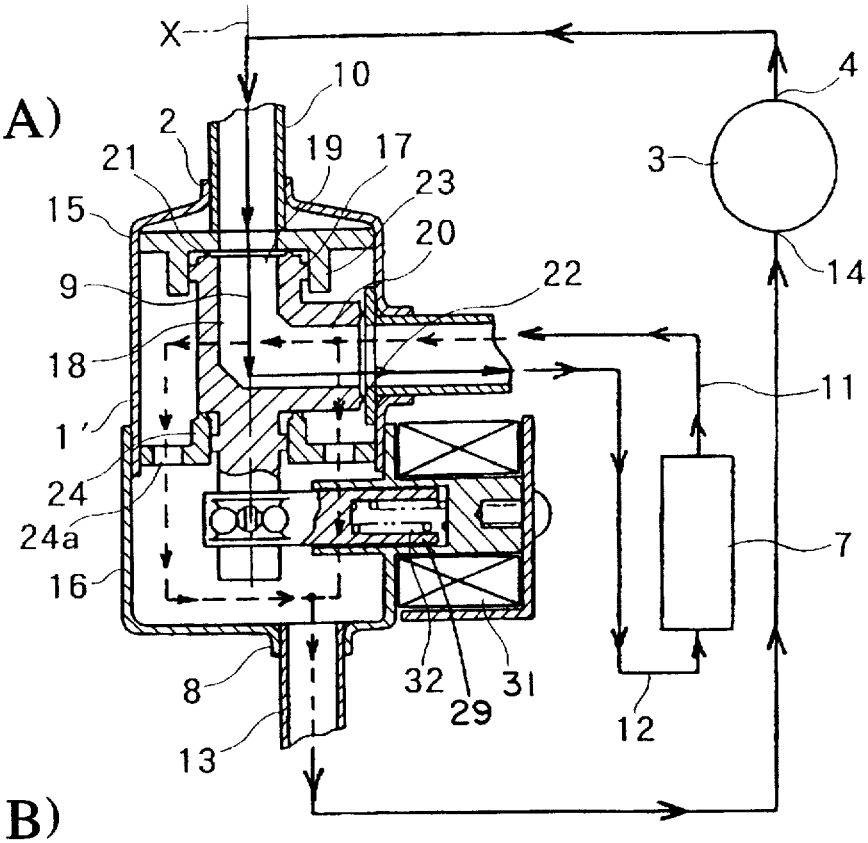
FIG. 2(A) is a vertical sectional view showing an example of a specific construction thereof.
Figure 2B:
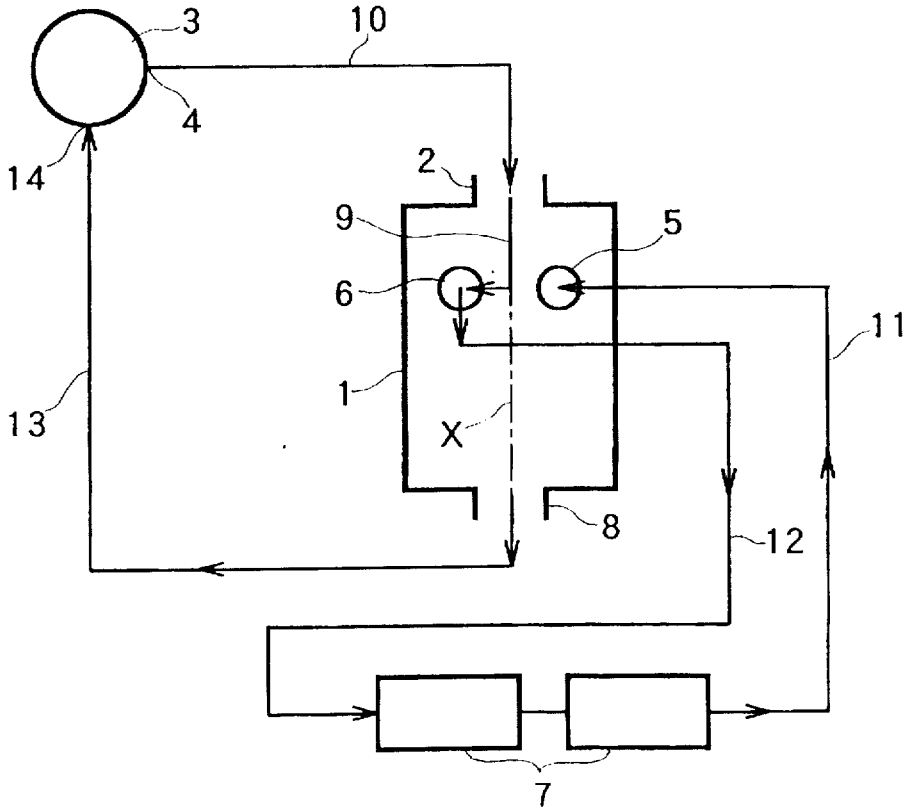
FIG. 2(B) is an explanatory view for explaining the principles of a high-low pressure flow passage switching device in a heating-cooling apparatus according to the first embodiment, in which the flow passage is switched to the other direction.
Figure 3:
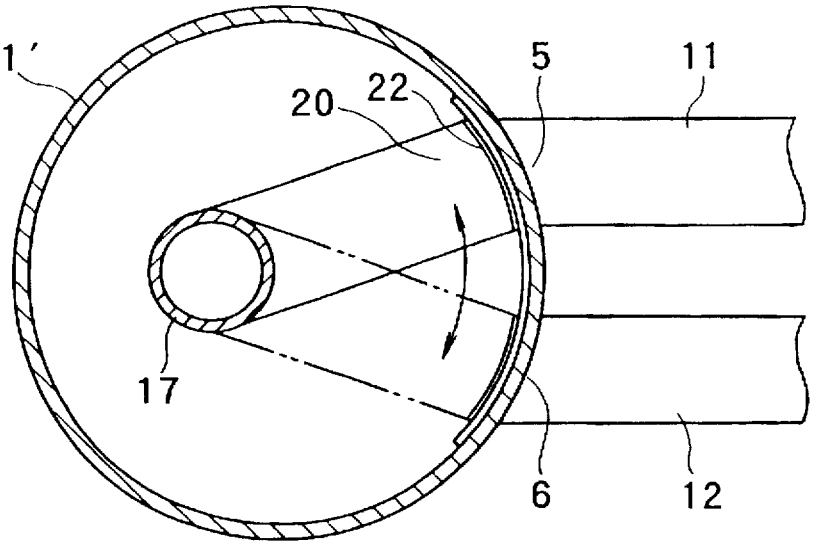
FIG. 3 is a vertical sectional view taken on line 3—3 of FIG. 1(A)
Figure 4:
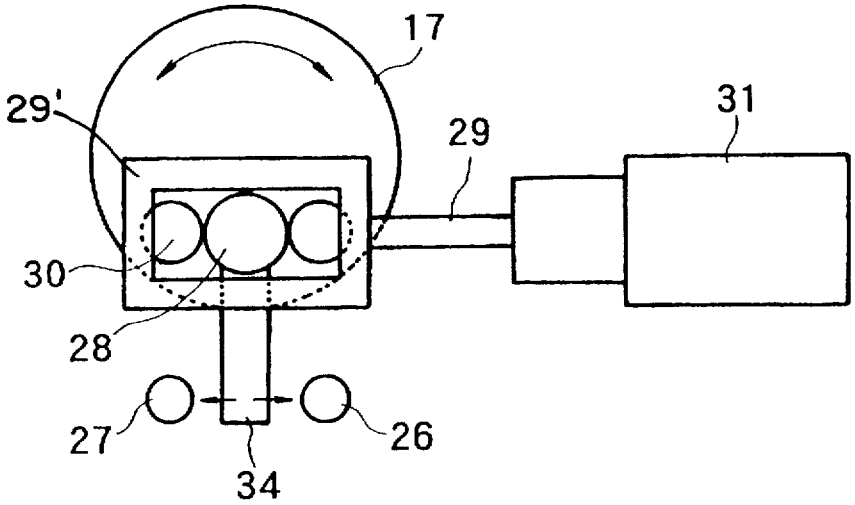
FIG. 4 is a bottom view showing a mechanism for rotatably switching a flow passage switching shaft using a plunger.

As shown in FIGS. 2(A) and 2(B), when the high pressure flow passage switching means 9 is switched to the second high/low pressure gas inlet/outlet port 6, the high pressure gas from the compressor 3 is allowed to pass through the piping 10, then pass through the high pressure gas inlet port 2, then pass through the gas passage 18 within the switching means 9 and is then supplied to the second high/low pressure gas inlet/outlet port 6. The high pressure gas from the port 6 is allowed to pass through the piping 12 and then is supplied to the other end of the heat exchanger 7. The low pressure gas from one end of the heat exchanger 7 is allowed to pass through the piping 11 and is then supplied to the first high/low pressure gas inlet/outlet port 5 so that the low pressure gas is filled in the hollow tube 1.

As described above, when the switching means 9 contained in the hollow tube 1 is switched to a selected one of the first and second high/low pressure gas inlet/outlet ports 5 and 6, the other of the ports 5 and 6 opens into the hollow tube 1 so that the hollow tube 1 is normally filled with the low pressure gas.

A low pressure gas outlet port 8 is formed in the wall of the hollow tube 1. This low pressure gas outlet port 8 is connected to a low pressure gas inlet port 14 of the compressor 3 through the piping 13. Owing to this arrangement, the low pressure gas discharged into the hollow tube 1 through the selected one of the first and second high/low pressure gas inlet/outlet ports 5 and 6 fills the interior of the tube 1 and at the same time, it is supplied to the inlet port 14 of the compressor 3 through the low pressure gas outlet port 8 and the piping 13. In this way, as shown in FIGS. 1 and 2, the high-low pressure passage for a coolant is switched.

As mentioned, the hollow tube 1 is provided with the high pressure gas inlet port 2, the first and second high/low pressure gas inlet/outlet ports 5 and 6, and the low pressure gas outlet port 8, and contains therein the high pressure flow passage switching means, thereby constituting a four-way switching valve. An example of a specific construction of this four-way switching valve will be described with reference to FIGS. 1, 2, 3 and 4.

The hollow tube 1 is formed of a metal cylindrical member 1' opposing ends of which are tightly closed. For example, this cylindrical member 1' is comprised of a first cylindrical member 15 and a second cylindrical member 16 as separate parts separated generally at a central portion. One end of the first cylindrical member 15 is fitted and welded to one end of the second cylindrical member 16 to thereby form a hollow structure. An outwardly projecting cylindrical high pressure gas inlet port 2 is formed at a central portion of one end wall of the cylindrical member 1', and an outwardly projecting cylindrical low pressure gas outlet port 8 is formed at a central portion of the other end wall. That is, the high pressure gas inlet port 2 and the low pressure gas outlet port 8 are arranged on an axis X of the cylindrical member 1' constituting the hollow tube 1.

The first and second high/low pressure gas inlet/outlet ports 5, 6 are formed in the side wall of the cylindrical member 1'. The ports 5, 6 are arranged in a juxtaposed relation at an area proximate to a circular orbit about the axis X of the cylindrical member 1'. More specifically, the high pressure gas inlet port 2 is arranged at one end wall on the axis X of the hollow tube 1, and the low pressure gas outlet port 8 is arranged at the other end wall on the same axis of the hollow tube 1. The first and second high/low gas inlet/outlet ports 5, 6 are arranged at an area proximate to the circular orbit about the axis of the side wall of the cylindrical member 1'.

The switching means 9 of the high pressure gas flow passage is constituted by a rotary switching shaft 17 which is rotated on the axis X within the hollow tube 1. The gas passage 18 is formed in the center of the rotary switching shaft 17. The gas passage 18 is provided at one end thereof with a high pressure gas inlet port (also referred to as a non-switching port) 19 opening at one end face of the shaft 17 so that the high pressure gas inlet port 19 is coaxially communicated with the high pressure gas inlet port 2, and at the other end with the high pressure gas outlet port (also referred to as a switching port) 20 opening at a side wall of the shaft 17, the gas pressure 18 being curved like an L-shape such that the high passage gas inlet port 19 forms one leg of the L-shape and the high pressure gas outlet port 20 forms the other leg of the L-shape and is able to communicate with a selected one of the first and second high/low pressure gas inlet/outlet ports 5 and 6. The rotary switching shaft 17 includes a rotary tubular shaft portion **17*a* extending on the axis X, and a radial tubular portion 17*b* radially extending from the rotary tubular shaft portion 17*a*. The portions 17*a* and 17*b* together form a generally L-shaped configuration. The L-shaped gas passage 18 extends through the center of the portions 17*a* and 17*b***.

A space between the high pressure gas inlet port 19 of the rotary switching shaft 17 and the high pressure gas inlet port 2 of the hollow tube 1 is made air-tight by a seal 21. Similarly, spaces between the high pressure gas outlet port 20 of the shaft 17 and the first and second high/low pressure gas inlet/outlet ports 5 and 6 are selectively made air-tight by seals 22. That is, the seals 21, 22 constitute means for preventing the high pressure gas from leaking into the hollow tube 1.

The rotary shaft portion **17*a* of the switching shaft 17 is supported at a peripheral surface of its end portion where the high pressure gas inlet port 19 is formed, by a bearing 23 such that it is held in the center of the shaft. A lower surface of the curved tube portion 17*b* of the rotary switching shaft 17 axially is supported by a bearing 24, and a peripheral surface of a lower end portion of the rotary shaft portion 17*a* of the rotary switching shaft 17 is radially supported on the bearing 24 for rotation about the axis X. Owing to the foregoing arrangement, the rotary switching shaft 17 is carried on the respective bearings 23 and 24 such that the rotary switching shaft 17 is rotated about a fixed axis and at a predetermined location. The bearing 24 is constituted by a circular plate which divides an intermediate portion of the hollow tube 1. This circular plate is provided with a through-hole 24***a* so that the low pressure gas is allowed to flow therethrough.

The rotary switching shaft 17 is rotated by a plunger 29 of a solenoid 31 extending through the side wall of the cylindrical member 1' constituting the hollow tube 1. A pressure receiving pin 28 consisting of a round pin is disposed in parallel with the axis X at an eccentric location relative to the axis X, at the end of the shaft portion extending along the axis X from an area of connection with the curved tube portion 17*b* of the rotary switching shaft 17. This pressure receiving pin 28 is pressed by a pair of balls 30 disposed in a frame 29' at a distal end of the plunger 29 of the solenoid 31 so that the rotary switching shaft 17 is rotated. The pair of balls 30 are disposed at 180-degree opposing locations of the pressure receiving pin 28 so that the pressure receiving pin 28 is clamped by the balls 30. Reciprocal movement of the plunger 29 causes the balls 30 to press against and move the pressure receiving pin 28 back and forth, so that the rotary switching shaft 17 is rotated.

The solenoid 31 is mounted on an outer surface of the hollow tube 1. By supplying and stopping the supply of electric current, the plunger 29 is caused to retract against a spring 32 and be extended by the spring 32, respectively, thereby pressing the pressure receiving pin 28 to move in first and second opposing directions between first and second positions. The pressure receiving pin 28 is biased by the spring 32 so as to be normally held in the second position (in which the plunger 29 is extended). Movement of the pressure receiving pin 28, which is normally contacted with the pair of balls 30 of the plunger 29 by resiliency of the spring 32, between the first and second positions causes rotation of the switching shaft 17 between the first and second rotary positions.

Accordingly, when the plunger 29 is retracted by the supply of electric current to the solenoid 31, the switching shaft 17 together with eccentrically located pressure receiving pin 28 are rotated through a predetermined angle in one direction. The rotation of the switching shaft 17 and pressure receiving pin 28 causes a selected one of the first and second high/low pressure gas inlet/outlet ports 5 and 6 (for example, port 5) to communicate with the high pressure gas outlet port 20. On the contrary, when the supply of electric current to the solenoid 31 is stopped, the plunger 29 is extended by the spring 32 to move the pressure receiving pin to the first position 28, so that the pressure receiving pin 28 and the switching shaft 17 are rotated through a predetermined angle by the spring 32. This rotation causes a selected one of the first and second high/low pressure gas inlet/outlet ports 5 and 6 (for example, port 6) to communicate with the high pressure gas outlet port 20.

Thus, the high pressure flow passage is switched by rotation of the switching shaft 17. At the time of switching, the high pressure gas inlet port 2 and the high pressure gas inlet port 19 are held in communication with each other on the axis X. Switching of the high pressure flow passage switching means 9 caused by reciprocal movement of the solenoid 31 may be operated in a reverse manner with respect to the above description.

As means for establishing an angle of rotation of the switching shaft 17, a first rotation stopper 26 and a second rotation stopper 27 are disposed on a circular orbit about the axis X. A rotary piece 34 capable of rotation in unison with the switching shaft 17 projects from one end of the switching shaft 17 or from a side surface of the pressure receiving pin 28 in a perpendicular direction (one sideward direction) to the axis X. The first and second rotation stoppers 26, 27 are arranged on the rotational orbit of the rotary piece 34. When the plunger 29 is retracted, the rotary piece 34 is abutted with the first rotation stopper 26, and when the plunger 29 is moved extended, the rotary piece 34 is abutted with the second stopper 27, thereby establishing the angle of rotation of the switching shaft 17.

The pressure receiving pin 28 may serve as a pressure receiving portion of the switching shaft 17. The balls 30 are rotatably held in opposing relation by the distal end of the plunger 29 and rotated while sliding on the surface of the pressure receiving pin 28 at a predetermined location, so that the switching shaft 17 may rotate smoothly.

As previously mentioned, the rotary shaft portion 17*a* of the switching shaft 17 coaxially extends on the axis X of the cylindrical member 1', and the plunger 29 reciprocally moves on the line perpendicular to the axis of the switching shaft 17 so that the pressure receiving pin 28 is pushed and pulled by the plunger 29 via the balls 30. By this, the switching shaft 17 is rotated about the axis X a predetermined angle in the first and second direction and the high/low pressure flow passage is switched with respect to the heat exchanger.

Next, basic ideas of the second embodiment are described with reference to FIGS. 5 and 6.

In these figures, reference numeral 1 denotes a hollow tube. A high pressure gas inlet port 2 is formed in the wall of this hollow tube 1. A high pressure gas outlet port 4 of a compressor 3 is connected to the high pressure gas inlet port 2 through a piping 10, so that a high pressure is supplied to the port 2 from the outlet port 4. The hollow tube 1 is provided at its wall with a low pressure gas inlet port 5 also serving as a first high pressure gas outlet port (hereinafter referred to as the "first high/low pressure gas inlet/outlet port"), and a lower pressure gas inlet port 6 also serving as a second high pressure gas outlet port (hereinafter referred to as the "second high/low pressure gas in let/outlet port"). The first high/low pressure gas inlet/outlet port 5 is connected to one end of a heat exchanger 7 through a piping 11, and the other end of the heat exchanger 7 is connected to the second high/low pressure gas inlet/outlet port 6 through a piping 12. The hollow tube 1 is further provided at its wall with a low pressure gas outlet port 8 connected to an inlet port 14 of the compressor 3 through a piping 13.

The hollow tube 1 contains therein a low pressure flow passage switching means 9' for switching the low pressure gas outlet port 8 selectively to one of the first and second high/low pressure gas inlet/outlet ports 5 and 6.

Figure 5A:
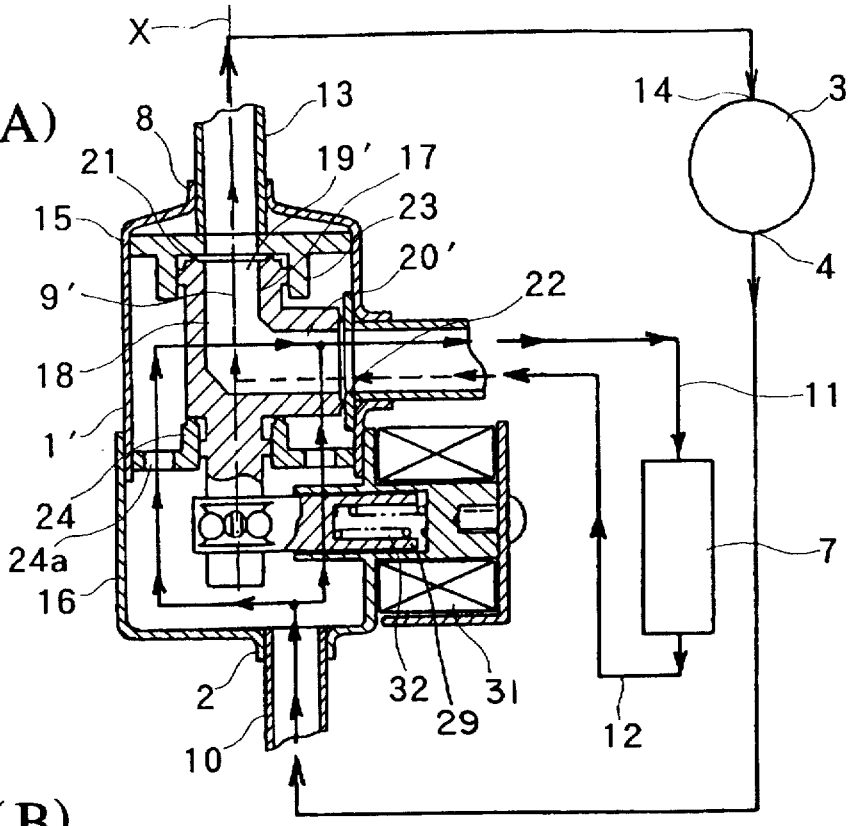
FIG. 5(A) is a vertical sectional view showing an example of a specific construction thereof.
Figure 5B:
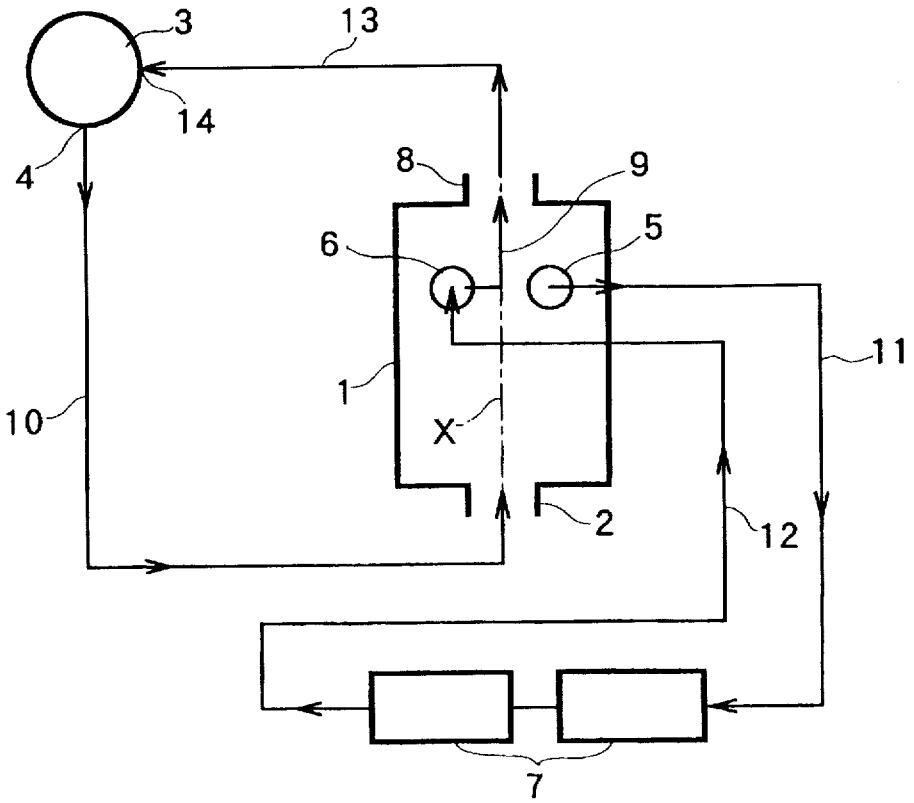
FIG. 5(B) is an explanatory view for explaining the principles of a high-low pressure flow passage switching device in a heating-cooling apparatus according to the second embodiment, in which the flow passage is switched to one direction.

As shown in FIGS. 5(A) and 5(B), when the passage switching means 9' is switched to the second high/low pressure gas inlet/outlet port 6, the first high/low pressure gas inlet/outlet port 5 is opened within the hollow tube 1, and the high pressure gas from the compressor 3 is introduced into the hollow tube 1 through the piping 10 and the high pressure gas inlet port 2 so that the interior of the hollow tube 1 is normally filled with the high pressure gas. This high pressure gas is allowed to pass through the first high/low pressure gas inlet/outlet port 5 which is in its open position, then pass through the piping 11 and is then supplied to one end of the heat exchanger 7. On the other hand, the lower pressure gas from the other end of the heat exchanger 7 is supplied to the second high/low pressure gas inlet/outlet port 6 through the piping 12, is then introduced to the switching means 9' and is then supplied into the inlet port 14 of the compressor 3 through a low pressure gas outlet port 19', the low pressure gas outlet port 8 and the piping 13.

Figure 6A:
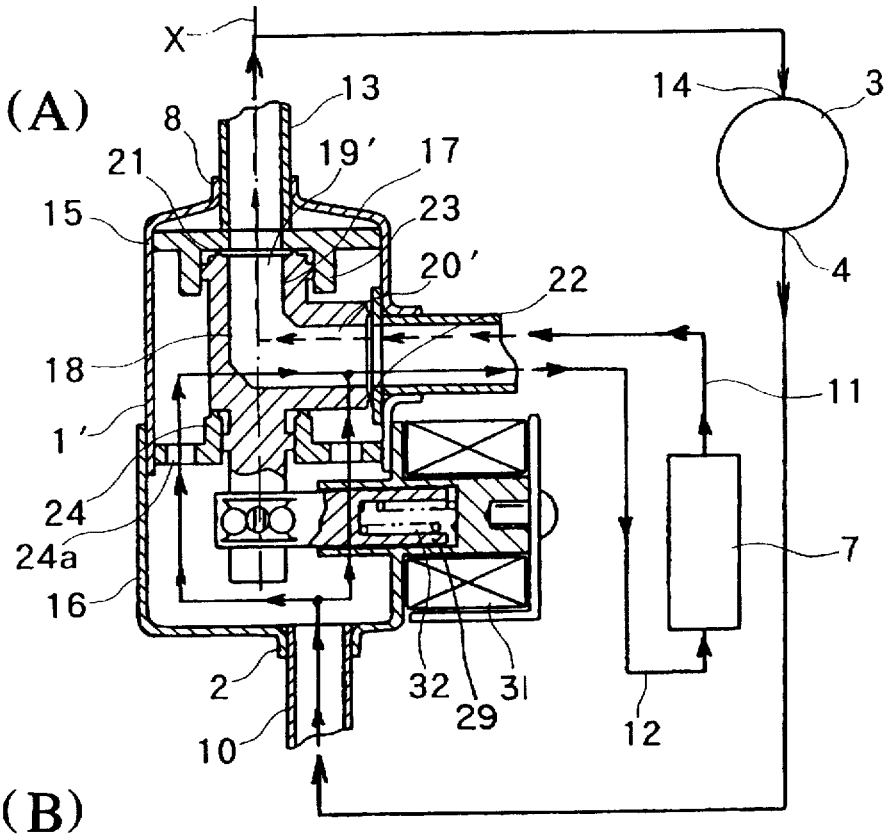
FIG. 6(A) is a vertical sectional view showing an example of a specific construction thereof.
Figure 6B:
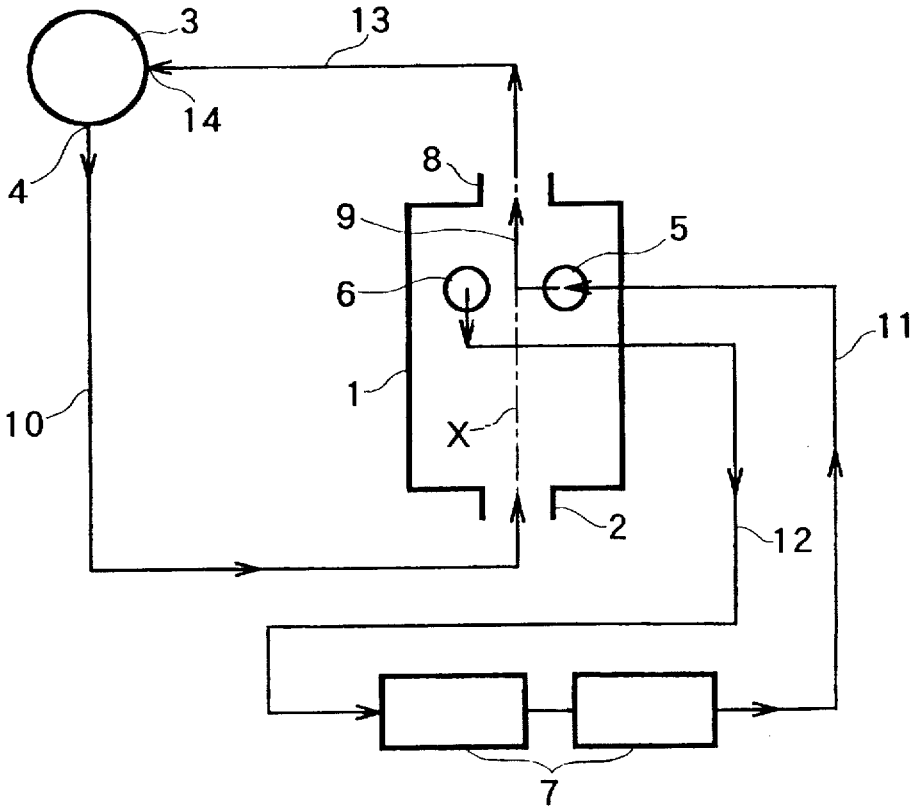
FIG. 6(B) is an explanatory view for explaining the principles of a high-low pressure flow passage switching device in a heating-cooling apparatus according to the second embodiment, in which the flow passage is switched to the other direction.

As shown in FIGS. 6(A) and 6(B), when the low pressure flow passage switching means 9' is switched to the first high/low pressure gas inlet/outlet port 5, the second high/low pressure gas inlet/outlet port 6 is opened within the hollow tube, and the high pressure gas from the compressor 3 is introduced into the hollow tube 1 through the piping 10 and the high pressure gas inlet port 2 so that the interior of the hollow tube 1 is normally filled with the high pressure gas. This high pressure gas is allowed to pass through the second high/low pressure gas inlet/outlet port 6 which is in its open position, then pass through the piping 12 and is then supplied to the other end of the heat exchanger 7. On the other hand, the lower pressure gas from one end of the heat exchanger 7 is supplied to the first high/low pressure gas inlet/outlet port 5 through the piping 11, then introduced to the switching means 9', and is then supplied into the inlet port 14 through the low pressure gas outlet port 19', the low pressure gas outlet port 8 and the piping 13.

In this way, as shown in FIGS. 5 and 6, the high/low pressure passage for a coolant is switched.

As mentioned, the hollow tube 1 is provided with the high pressure gas inlet port 2, the first and second high/low pressure gas inlet/outlet ports 5 and 6, and the low pressure gas outlet port 8, and contains therein the low pressure flow passage switching means 9', thereby constituting a four-way switching valve. A mechanical construction of this four-way switching valve is quite the same as the first embodiment. The high pressure flow passage switching means 9 of the first invention constitutes the low pressure flowing passage switching means 9'. An example of a specific construction of this four-way switching valve will be described with reference to FIGS. 5(A) and 6(A).

The hollow tube 1, as in the preceding embodiment, is formed of a metal cylindrical member 1' opposing ends of which are tightly closed. For example, this cylindrical member 1' is comprised of a first cylindrical member 15 and a second cylindrical member 16 as separate parts separated generally at a central portion. One end of the first cylindrical member 15 is fitted and welded to one end of the second cylindrical member 16 to thereby form a hollow structure. An outwardly projecting cylindrical high pressure gas inlet port 2 is formed at a central portion of one end wall of the cylindrical member 1', and an outwardly projecting cylindrical low pressure gas outlet port 8 is formed at a central portion of the other end wall. That is, the high pressure gas inlet port 2 and the low pressure gas outlet port 8 are arranged on an axis X of the cylindrical member 1' constituting the hollow tube 1.

The first and second high/low pressure gas inlet/outlet ports 5, 6 are formed in the side wall of the cylindrical member 1'. The ports 5, 6 are arranged in a juxtaposed relation at an area proximate to a circular orbit about the axis X of the cylindrical member 1'. More specifically, the high pressure gas inlet port 2 is arranged at one end wall on the axis X of the hollow tube 1, and the low pressure gas outlet port 8 is arranged at the other end wall on the same axis X of the hollow tube 1. The first and second high/low pressure gas inlet/outlet ports 5, 6 are arranged at an area proximate to the circular orbit about the axis of the side wall of the cylindrical member 1'.

The switching means 9' of the low pressure gas flow passage is constituted by a rotary switching shaft 17 which is rotated on the axis X within the hollow tube 1. The gas passage 18 is formed in the center of the rotary switching shaft 17. The gas passage 18 is provided at one end thereof with the low pressure gas outlet port 19' opening at one end face of the shaft 17 so that the low pressure gas outlet port 19' is coaxially communicated with the low pressure gas outlet port 2, and at the other end with the low pressure gas inlet port 20' opening at a side wall of the shaft 17, the gas passage 18 being curved like an L-shape such that the low pressure gas outlet port 19' forms one leg of the L-shape and the low pressure gas inlet port 20' forms the other leg of the L-shape and is able to communicate with a selected one of the first and second high/low pressure gas inlet/outlet ports 5 and 6. The rotary switching shaft 17 includes a rotary tubular shaft portion 17*a* extending on the axis X, and a radial tubular portion 17*b* radially extending from the rotary tubular shaft portion 17*a*. The portions 17*a* and 17*b* together form a generally L-shaped configuration. The L-shaped gas passage 18 extends through the center of the portions 17*a* and 17*b*.

A space between the low pressure gas outlet port 19' of the rotary switching shaft 17 and the low pressure gas outlet port 8 of the hollow tube 1 is made air-tight by seal 21. Similarly, spaces between the low pressure gas inlet port 20' of the shaft 17 and the first and second high/low pressure gas inlet/outlet ports 5 and 6 are selectively made air-tight by seals 22. That is, the seals 21, 22 are means for preventing the low pressure gas from leaking into the hollow tube 1.

The rotary shaft portion 17*a* of the switching shaft 17 is supported at a peripheral surface of its end portion where the low pressure gas outlet port 19' is formed, by a bearing 23 such that it is held in the center of the shaft. A lower surface of the curved tube portion 17*b* of the rotary switching shaft 17 is axially supported on a bearing 24, and a peripheral surface of a lower end portion of the rotary shaft portion 17*a* of the rotary switching shaft 17 is radially supported on the bearing 24 for rotation about the axis X. Owing to the foregoing arrangement, the rotary switching shaft 17 is carried on the respective bearings 23 and 24 such that the rotary switching shaft 17 is rotated about a fixed axis and at a predetermined location. The bearing 24 is constituted by a circular plate which divides an intermediate portion of the hollow tube 1. This circular plate is provided with a through-hole 24*a* so that the high pressure gas is allowed to flow within the hollow tube 1.

The rotary switching shaft 17 is rotated by a plunger 29 of a solenoid 31 extending through the side wall of the cylindrical member 1' constituting the hollow tube 1. A pressure receiving pin 28 consisting of a round pin is disposed in parallel with the axis X at an eccentric location, relative to the axis X, at the end of the shaft portion extending along the axis X from an area of connection with the curved tube portion 17*b* of the rotary switching shaft 17. This pressure receiving pin 28 is pressed by a pair of balls 30 disposed at a distal end of the plunger 29 of the solenoid 31 so that the rotary switching shaft 17 is rotated. The pair of balls 30 are disposed at 180-degree opposing locations of the pressure receiving pin 28 so that the pressure receiving pin 28 is clamped by the balls 30. Reciprocal movement of the plunger 29 causes the balls 30 to press against and move the pressure receiving pin 28 back and forth, so that the rotary switching shaft 17 is rotated.

The solenoid 31 is mounted on an outer surface of the hollow tube 1. By Supplying and stopping the supply of electric current, the plunger 29 is caused to retract against a spring 32 and be extended by the spring 32, thereby pressing the pressure receiving pin 28 to move in first and second opposing directions between first and second positions. The pressure receiving pin 28 is biased by the spring 32 so as to be normally held in the second position (in which the plunger 29 is extended). Movement of the pressure receiving pin 28, which is normally contacted with the pair of balls 30 of the plunger 29 by resiliency of the spring 32, between the first and second positions causes rotation of the switching shaft 17 between the first and second rotary positions.

Accordingly, when the plunger 29 is retracted by the supply of electric current to the solenoid 31, the switching shaft 17 together with the eccentrically located pressure receiving pin 28 are rotated through a predetermined angle in one direction. The rotation of the switching shaft 17 and pressure receiving pin 28 causes a selected one of the first and second high/low pressure gas inlet/outlet ports 5 and 6 (for example, 5) to communicate with the low pressure gas inlet port 20'. On the contrary, when the supply of electric current to the solenoid 31 is stopped, the plunger 29 is extended by the spring 32 to move the pressure receiving pin 28 to the first position, so that the pressure receiving pin 28 and the switching shaft 17 are rotated through a predetermined angle by the spring 32. This rotation causes a selected one of the first and second high/low pressure gas inlet/outlet ports 5 and 6 (for example, port 6) to communicate with the low pressure gas inlet port 20'. Reciprocal movement of the plunger 29 and switching operation of the switching shaft 17 may be operated in a reverse manner with respect to the above description.

Thus, the low pressure flow passage is switched by rotation of the switching shaft 17 and the high pressure flow passage is indirectly switched. At the time of switching, the low pressure gas outlet port 8 and the low pressure gas outlet port 19' are held in communication with each other on the axis X.

As means for establishing an angle of rotation of the switching shaft 17, a first rotation stopper 26 and a second rotation stopper 27 are disposed on a circular orbit about the axis X. A rotary piece 34 capable of rotation in unison with the switching shaft 17 projects from one end of the switching shaft 17 or from a side surface of the pressure receiving pin 28 in a perpendicular direction (one sideward direction) to the axis X. The first and second rotation stoppers 26, 27 are arranged on the rotational orbit of the rotary piece 34. When the plunger 29 is retracted, the rotary piece 34 is abutted with the first rotation stopper 26, and when the plunger 29 is extended, the rotary piece 34 is abutted with the second stopper 27, thereby establishing the angle of rotation of the switching shaft 17.

The pressure receiving pin 28 may serve as a pressure receiving portion of the switching shaft 17. The balls 30 are rotatably held in opposing relation by the distal end of the plunger 29 and rotated while sliding on the surface of the pressure receiving pin 28 at a predetermined location, so that the switching shaft 17 may rotate smoothly.

As previously mentioned, the rotary shaft portion 17*a* of the switching shaft 17 coaxially extends on the axis X of the cylindrical member 1', and the plunger 29 reciprocally moves on the line perpendicular to the axis of the switching shaft 17 so that the pressure receiving pin 28 is pushed and pulled by the plunger 29 via the balls 30. By this, the switching shaft 17 is rotated about the axis X a predetermined angle in the first or second direction and the high/low pressure flowing passage is switched with respect to the heat exchanger.

Figure 7:
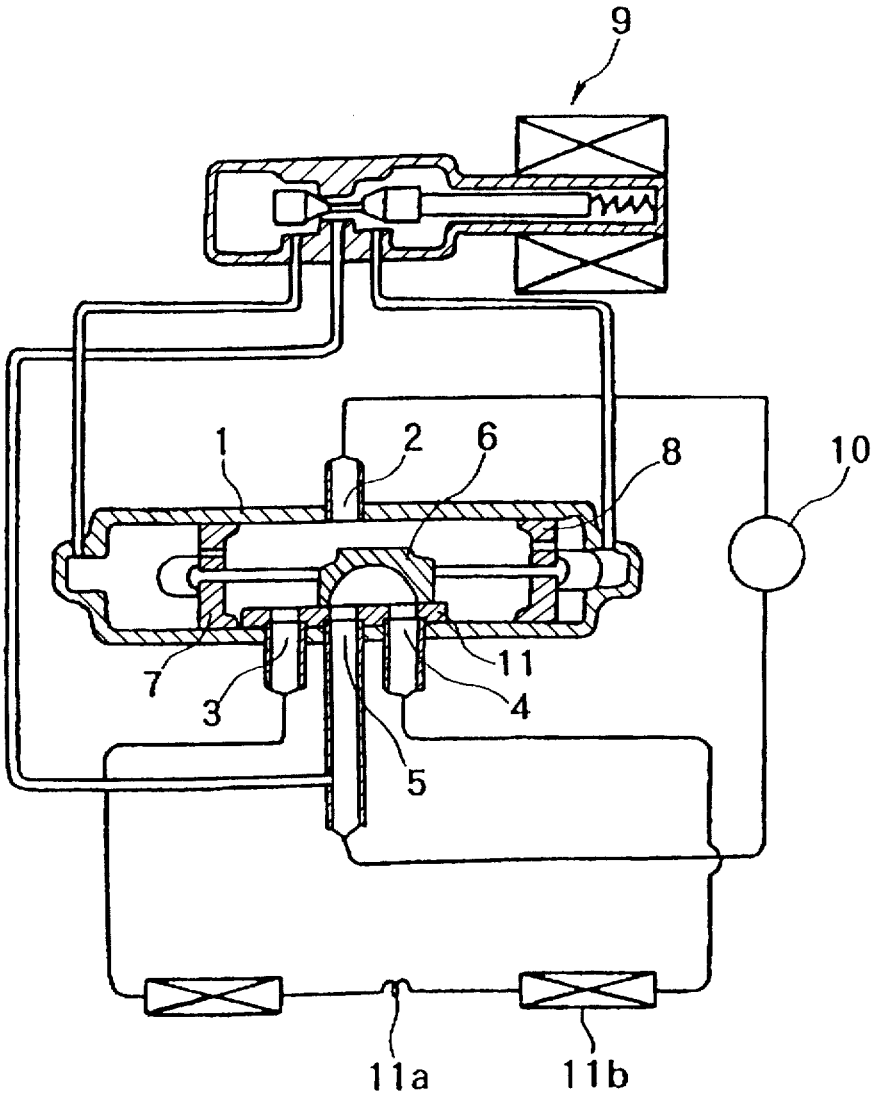
FIG.7 PRIOR ART
FIG. 7 is a sectional view showing a high-low pressure flow passage switching device in a conventional heating-cooling apparatus utilizing a four-way switching valve.

According to the first and second embodiments, in any of the switching modes, the switching means rotates the rotary shaft and since the switching slide surface area is extremely limited, sliding resistance is very small. Accordingly, compared with the prior art of FIG. 7 in which the slide block having a comparatively large sliding surface area is reciprocally slid, sliding resistance occurring at the sealing portion of the switching means can be reduced extensively, thus enabling the switching means to slide smoothly.

This effect is especially significant, according to the first embodiment, because the interior of the hollow tube is filled with a low pressure gas introduced through a selected one of the first and second high/low pressure gas inlet/outlet ports and thus the above switching operation is carried out in a low pressure gas atmosphere.

As a consequence, reliability of the switching means is extremely good when a switching operation is required. In addition, it is possible to solve the problem of the sliding surface being readily worn at the sealing portion such that is difficult to attain sufficient sealing. That is, compared with the conventional four-way switching valve construction in which the flow passage switching slide block having a comparatively large area is abutted at one side thereof with the surface of the valve seat and linearly reciprocally slid by a pilot valve, reliability and durability are extensively increased. Moreover, since the number of component parts is reduced and the construction is remarkably simplified, the cost can be lowered considerably.

Furthermore, the high pressure gas inlet port (low pressure gas outlet port) and the high pressure gas outlet port (low pressure gas inlet port) are normally and reliably communicated with each other. The high pressure gas outlet port (low pressure gas inlet port) formed in the end of the gas passage disposed at the side wall of the switching shaft is rotated about the axis so that the first and second high/low pressure gas inlet/outlet ports can be easily and selectively brought into alignment therewith. Thus, a reliable switching can be obtained through rotation of the switching shaft about the fixed axis.

Moreover, the eccentric portion (i.e. the pressure receiving pin) of the switching shaft is held by the pair of balls disposed on the plunger so as to be respectively pushed and pulled in opposing directions. Accordingly, rotation of the switching shaft and thus a switching operation of the flow passage can be made with a small force and in a stable manner. Thus, along with the above-mentioned effect of reduction of sliding resistance, reliability of the switching operation is enhanced.

While some preferred embodiments of a high-low pressure passage switching device in a heating-cooling apparatus according to the present invention have thus far been described with reference to the accompanying drawings, it should be borne in mind that such embodiments are merely illustrative of the gist of the present invention and are accordingly subject to modification and change.

What is claimed is:

1. A high-low pressure passage switching device for use in a heating-cooling apparatus including a compressor and a heat exchanger, said switching device comprising:

a hollow tube;

a high pressure gas inlet port formed in a wall of said hollow tube and being connectable to a high pressure gas outlet port of the compressor;

a first high pressure gas outlet port/low pressure gas inlet port formed in the wall of said hollow tube and being connectable to a first end of the heat exchanger;

a second high pressure gas output port/low pressure gas inlet port formed in the wall of said hollow tube and being connectable to a second end of the heat exchanger;

a flow passage switching member rotatably disposed within said hollow tube for rotation about a fixed axis to supply a high pressure gas introduced from said high pressure gas inlet port selectively to one of said first high pressure gas outlet port/low pressure gas inlet port and said second high pressure gas outlet port/low pressure gas inlet port to thereby switch a flow direction of the high pressure gas;

wherein, when a high pressure gas is supplied to the first end of said heat exchanger through a selected one of said first high pressure gas outlet port/low pressure gas inlet port, a low pressure gas from the second end of the heat exchanger is introduced into said hollow tube through the other of said first high pressure gas outlet port/low pressure gas inlet port and said high pressure gas outlet port/low pressure gas inlet port so that the interior of said hollow tube is normally filled with low pressure gas; and wherein a low pressure gas outlet port is formed in the wall of said hollow tube and connected to a low pressure gas inlet port of the compressor so that the low pressure gas within said hollow tube is guided to the low pressure gas inlet port of the compressor.

2. A high-low pressure passage switching device as defined in claim 1, wherein said hollow tube has an axis, first and second axially opposed end walls and a side wall, and wherein said high pressure gas inlet port is disposed at said first end wall of said hollow tube, said low pressure gas outlet port is disposed at said second end wall of said hollow tube, and said first and second high pressure gas outlet ports/low pressure gas inlet ports are disposed on a circular orbit about said axis of said hollow tube.

3. A high-low pressure passage switching device as defined in claim 1, wherein said flow passage switching member is constituted by a rotary switching shaft rotatable about said axis within said hollow tube, and a gas passage is formed through said rotary switching shaft, said gas passage being provided at one end thereof with a high pressure gas inlet port opening at an axial end face of said shaft so as to be communicated with said high pressure gas inlet port, and at the other end with a high pressure gas outlet port opening at a radial side of said shaft so as to be communicated with a selected one of said first and second high pressure gas outlet ports/low pressure gas inlet ports.

4. A high-low pressure passage switching device as defined in claim 3, further comprising a plunger extending through said side wall of said hollow tube and being operably connected to said rotary switching shaft.

5. A high-low pressure passage switching device as defined in claim 4, wherein said rotary switching shaft is provided at one end thereof with a pressure-bearing portion located eccentrically with respect to said axis, and wherein said plunger includes a ball disposed at a distal end thereof and pressing against said pressure bearing portion for rotating said rotary switching shaft.

6. A high-low pressure passage switching device for use in a heating-cooling apparatus including a compressor and a heat exchanger, said switching device comprising:

a hollow tube;

a high pressure gas inlet port formed in a wall of said hollow tube and being connectable to a high pressure gas outlet port of the compressor so that a high pressure gas from the compressor is introduced into said hollow tube to normally fill the interior of said hollow tube and being connectable to a first end of the heat exchanger;

a first high pressure gas outlet port/low pressure gas inlet port formed in the wall of said hollow tube and being connectable to a first end of the heat exchanger;

a second high pressure gas outlet port/low pressure gas inlet port formed in the said wall of said hollow tube and being connectable to a second end of the heat exchanger;

a low pressure gas outlet port formed in said wall of said hollow tube and being connectable to an inlet port of the compressor;

a flow passage switching member rotatably disposed within said hollow tube for rotation about a fixed axis to cause said low pressure gas outlet port to communicate selectively with one of said first high pressure gas outlet port/low pressure gas inlet port and said second high pressure gas outlet port/low pressure gas inlet port; and wherein, when said switching member is switched to a selected one of said first high pressure gas outlet port/low pressure gas inlet port, and said second high pressure gas outlet port/low pressure gas inlet port, the high pressure gas within said hollow tube is guided to one of the first and second ends of the heat exchanger through the other of said first high pressure gas outlet port/low pressure gas inlet port and said second high pressure gas outlet port/low pressure gas inlet port, and the low pressure gas from the other one of the first and second ends of the heat exchanger is introduced into said flow passage switching member so that the low pressure gas is guided to an inlet port of the compressor from said low pressure gas outlet port.

7. A high-low pressure passage switching device as defined in claim 6, wherein said hollow tube has an axis, first and second axially opposed end walls and a side wall, and wherein said high pressure gas inlet port is disposed at said first end wall of said hollow tube, said low pressure gas outlet port is disposed at said second end wall of said hollow tube, and said first high pressure gas outlet port/low pressure gas inlet port and said second high pressure gas outlet port/low pressure gas inlet port are disposed on a circular orbit about said axis of said hollow tube.

8. A high-low pressure passage switching device as defined in claim 6, wherein said flow passage switching member is constituted by a rotary switching shaft rotatable about said axis within said hollow tube, and a gas passage is formed through said rotary switching shaft, said gas passage being provided at one end thereof with a low pressure gas outlet port opening at one axial end face of said shaft so as to be communicated with said low pressure gas inlet port opening at a radial side of said shaft so as to be communicated with a selected one of said first and second high pressure gas outlet ports/low pressure gas inlet ports.

9. A high-low pressure passage switching device as defined in claim 8, further comprising a plunger extending through said side wall of said hollow tube and being operably connected to said rotary switching shaft.

10. A high-low pressure passage switching device as defined in claim 9, wherein said rotary switching shaft is provided at one end thereof with a pressure-bearing portion located eccentrically with respect to said axis, and wherein said plunger includes a ball disposed at a distal end thereof and pressing against said pressure bearing portion for rotating said rotary switching shaft.

11. A high-low pressure passage switching arrangement comprising:

a hollow tube including a wall with a chamber defined therein;

a flow passage switching member, mounted in said hollow tube, having a gas flow passage formed therethrough with a non-switching port being defined at a first end of said gas flow passage and a switching port being defined at a second end of said gas flow passage;

wherein a first port is formed in said wall of said hollow tube and is aligned and communicated with said non-switching port of said flow passage switching member;

wherein a second port is formed in said wall of said hollow tube and communicates said chamber with an outside of said hollow tube;

wherein third and fourth ports are formed in said wall of said hollow tube; and wherein said flow passage switching member is rotatably mounted in said hollow tube for rotation about a fixed axis, aligned with an axis of said first port of said hollow tube and an axis of said non-switching port of said gas flow passage, between a first rotary position in which said switching port of said gas flow passage is aligned with said third port of said hollow tube and a second rotary position in which said switching port is aligned with said fourth port of said hollow tube.

12. A high-low pressure passage switching arrangement as defined in claim 11, wherein said gas flow passage of said flow passage switching member includes a first passage portion, one end of which defines said non-switching port, having a longitudinal axis parallel to said axis of said first port of said hollow tube, and a second passage portion, one end of which defines said switching port, having a longitudinal axis perpendicular to said longitudinal axis of said first passage portion.

13. A high-low pressure passage switching arrangement as defined in claim 12, wherein said hollow tube has a longitudinal axis, and said wall of said hollow tube comprises first and second opposing end walls and a side wall;

said first and second ports are formed in said first and second end walls, respectively; and said third and fourth ports are formed in said side wall.

14. A high-low pressure passage switching arrangement as defined in claim 12, further comprising a linearly reciprocable plunger operably connected with said flow passage switching member at a location thereof offset from said fixed axis.

15. A high-low pressure passage switching arrangement as defined in claim 14, further comprising a solenoid operably coupled to said linearly reciprocable plunger.

16. A high-low pressure passage switching arrangement as defined in claim 15, wherein said plunger includes a frame at one end thereof;

at least one ball is disposed in said frame;

a pressure receiving member is fixed to said flow passage switching member at said location offset from said fixed axis; and said pressure receiving member and said at least one ball are disposed in said frame;

whereby linear reciprocation of said plunger causes said pressure receiving member to be moved between first and second positions so as to cause rotation of said flow passage switching member about said fixed axis between said first and second rotary positions.

17. A high-low pressure passage switching arrangement as defined in claim 16, further comprising a rotary piece fixed to one of said flow passage switching member and said pressure receiving member and projecting therefrom in a generally radial direction relative to said fixed axis; and a pair of rotation stoppers for defining a range of rotation of said flow passage switching member and thereby defining said first and second rotary positions of said flow passage switching member.

18. A high-low pressure passage switching arrangement as defined in claim 12, further comprising a compressor having an outlet port fluidically connected to said first port of said hollow tube, and an inlet port fluidically connected to said second port of said hollow tube; and a heat exchanger having a first port fluidically connected to said third port of said hollow tube, and a second port fluidically connected to said fourth port of said hollow tube.

19. A high-low pressure passage switching arrangement as defined in claim 12, further comprising a compressor having an inlet port fluidically connected to said first port of said hollow tube, and an outlet port fluidically connected to said second port of said hollow tube; and a heat exchanger having a third port fluidically connected to said first port of said hollow tube, and a second port fluidically connected to said fourth port of said hollow tube.

* * * * *